US009537233B1

(12) United States Patent
Adrian

(10) Patent No.: US 9,537,233 B1
(45) Date of Patent: Jan. 3, 2017

(54) STORAGE DEVICE CONNECTOR

(71) Applicant: Facebook, Inc., Menlo Park, CA (US)

(72) Inventor: Jason David Adrian, Menlo Park, CA (US)

(73) Assignee: Facebook, Inc., Menlo Park, CA (US)

( * ) Notice: Subject to any disclaimer, the term of this patent is extended or adjusted under 35 U.S.C. 154(b) by 0 days.

(21) Appl. No.: 14/940,381

(22) Filed: Nov. 13, 2015

(51) Int. Cl.
*H01R 24/00* (2011.01)
*H01R 12/57* (2011.01)

(52) U.S. Cl.
CPC ..... *H01R 12/57* (2013.01)

(58) Field of Classification Search
CPC ..... H01R 12/73; H01R 12/737; H01R 12/52; H01R 9/096
USPC ..... 439/637, 65, 490
See application file for complete search history.

(56) References Cited

U.S. PATENT DOCUMENTS 4,274,699 A * 6/1981 Keim ..... H01R 12/58 439/637
5,273,461 A * 12/1993 Lee ..... H01R 12/82 439/637
5,509,826 A * 4/1996 White ..... H01R 12/7005 439/637
5,639,265 A * 6/1997 Nishio ..... H01R 12/714 439/630
5,775,950 A * 7/1998 Tsuji ..... H01R 12/721 439/637
5,810,623 A * 9/1998 Regnier ..... H01R 12/721 439/637
5,853,303 A * 12/1998 Brunker ..... H01R 13/6474 439/60
6,149,468 A * 11/2000 Meng ..... H01R 12/82 439/637
7,300,315 B2 * 11/2007 Lai ..... H05K 1/18 439/637
7,458,842 B1 * 12/2008 Gange ..... H01R 13/62988 439/160
8,215,994 B2 * 7/2012 Duenas ..... H01R 13/6471 439/637
8,882,522 B2 * 11/2014 Jiang ..... H01R 13/405 439/160

* cited by examiner

*Primary Examiner* — Hae Moon Hyeon
(74) *Attorney, Agent, or Firm* — Perkins Coie LLP

(57) ABSTRACT

Technology is provided for a connector for use with an M.2 memory module. The connector comprises a connector body including a mounting surface, first and second receptacles oriented perpendicular to the mounting surface, and a plurality of terminals extending through the mounting surface and into the first and second receptacles.

19 Claims, 6 Drawing Sheets

STORAGE DEVICE CONNECTOR

TECHNICAL FIELD

This patent application is directed to storage device connectors and, more specifically, to M.2 connectors.

BACKGROUND

Conventional M.2 connectors have a connector body with a mounting surface that is parallel with the receptacles that receive a storage device. Accordingly, conventional M.2 connectors are mounted on a printed circuit board (PCB) with the receptacles parallel to the printed circuit board. Therefore, a connected storage device lies parallel to the PCB. Thus, the storage device consumes a relatively large portion of the PCB's surface area.

BRIEF DESCRIPTION OF THE DRAWINGS

Embodiments of the storage device connectors introduced herein may be better understood by referring to the following Detailed Description in conjunction with the accompanying drawings, in which like reference numerals indicate identical or functionally similar elements.

Figure 1:
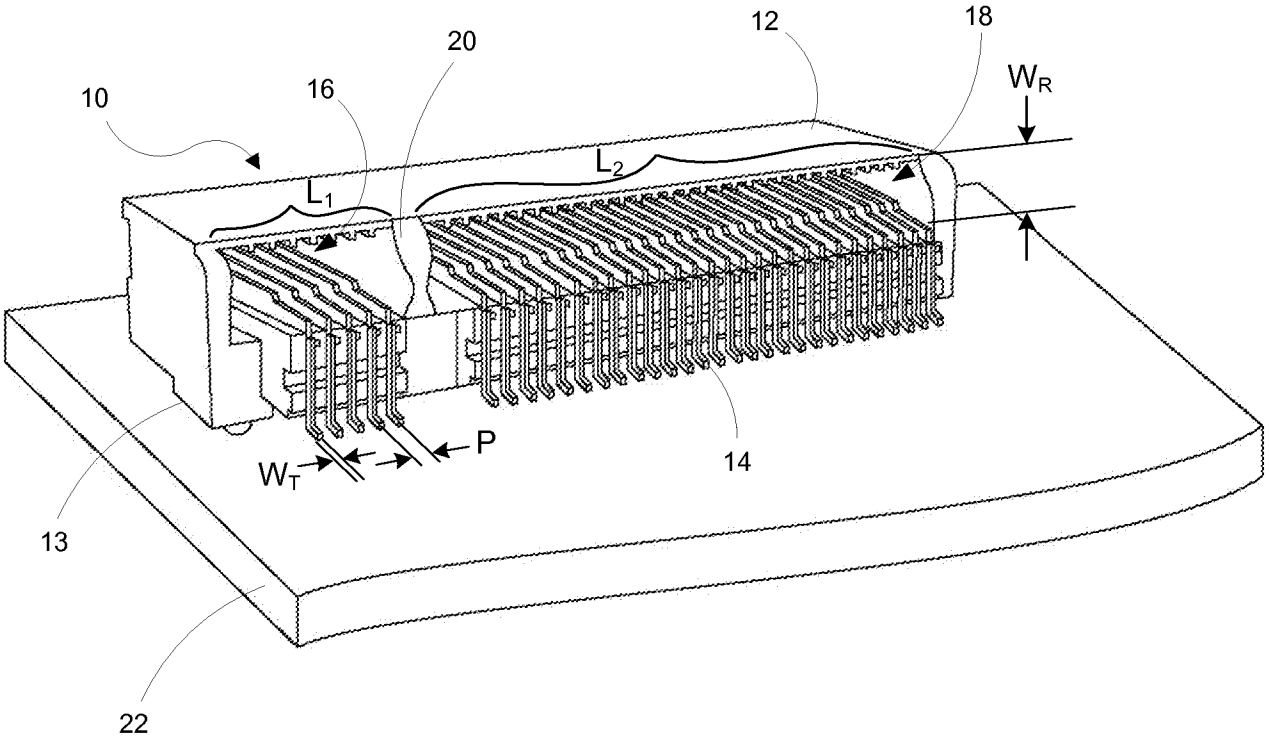
FIG. 1 (PRIOR ART)
FIG. 1 is a perspective view of a conventional M.2 or next generation form factor (NGFF) connector.

The headings provided herein are for convenience only and do not necessarily affect the scope or meaning of the claimed embodiments. Further, the drawings have not necessarily been drawn to scale. For example, the dimensions of some of the elements in the figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to limit the embodiments described. On the contrary, the embodiments are intended to cover all modifications, equivalents, and alternatives falling within the scope of the embodiments as defined by the appended claims.

DETAILED DESCRIPTION

Overview

Technology is provided for a connector for use with an M.2 memory module. These connectors and memory modules are sometimes referred to as M.2 NGFF or NGFF. The connector comprises a connector body including a mounting surface, first and second receptacles oriented perpendicular to the mounting surface, and a plurality of terminals extending through the mounting surface and into the first and second receptacles. Because the connector's receptacles are oriented perpendicular to the mounting surface, a corresponding memory module consumes less space on a PCB than with a conventional parallel M.2 connector. Thus, multiple memory modules can be mounted in an area corresponding to a single parallel memory module.

General Description

Various examples of the devices introduced above will now be described in further detail. The following description provides specific details for a thorough understanding and enabling description of these examples. One skilled in the relevant art will understand, however, that the techniques discussed herein may be practiced without many of these details. Likewise, one skilled in the relevant art will also understand that the technology can include many other features not described in detail herein. Additionally, some well-known structures or functions may not be shown or described in detail below so as to avoid unnecessarily obscuring the relevant description.

The terminology used below is to be interpreted in its broadest reasonable manner, even though it is being used in conjunction with a detailed description of some specific examples of the embodiments. Indeed, some terms may even be emphasized below; however, any terminology intended to be interpreted in any restricted manner will be overtly and specifically defined as such in this section.

As shown in FIG. 1, a conventional M.2 or next generation form factor (NGFF) connector 10 includes a connector body 12 having first and second receptacles 16 and 18, respectively. Receptacles 16 and 18 are separated by a partition 20. First receptacle 16 has a receptacle length $L_1$ and second receptacle 18 has a receptacle length $L_2$. Conventional M.2 receptacle lengths are typically designated by the number of terminals 14 positioned in the receptacle. The length $L_1$ of the first receptacle 16 and the corresponding position of the partition 20 determine the key of the connector. The position of partition 20 prevents an incompatible storage device from being plugged into the connector 10. Conventional M.2 connectors are commonly keyed as either an M key or a B key. For example, the B-keyed M.2 connector, shown in FIG. 1 has a first receptacle length $L_1$ that is six terminals wide. An M-keyed M.2 connector has a first receptacle length $L_1$ that is five terminals wide.

The conventional M.2 connector terminals 14 have a width $W_T$ and are spaced apart by a pitch P. Conventional M.2 connectors have a terminal width $W_T$ of between approximately 0.12 and approximately 0.23 millimeters and a pitch P of approximately 0.5 millimeters. Conventional M.2 connectors have a receptacle opening width $W_R$ ranging from approximately 0.72 to approximately 0.88 millimeters. Connector 10 has a mounting surface 13 that is parallel with the receptacles 16 and 18. Accordingly, the connector 10 is mounted on a printed circuit board 22 with the receptacles 16 and 18 parallel to the printed circuit board.

Figure 2B:
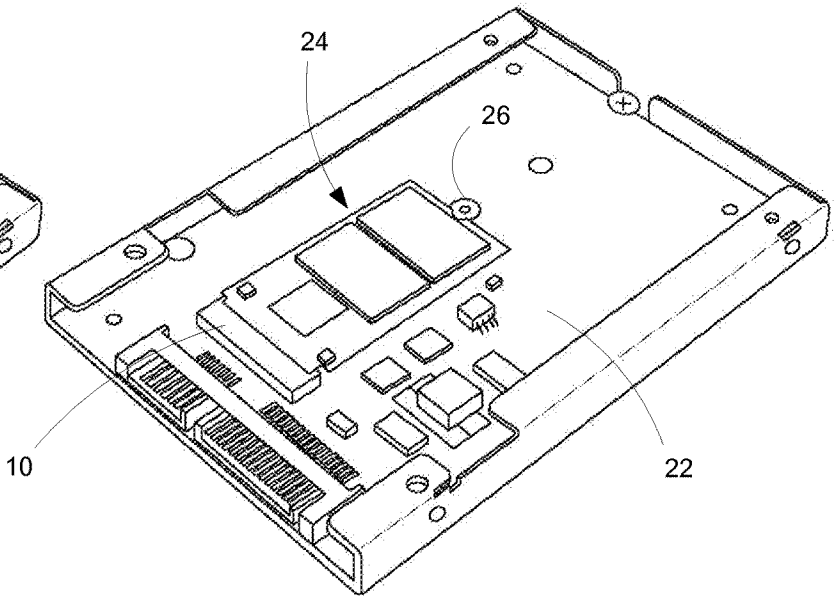
FIG. 2B (PRIOR ART)
FIGS. 2A and 2B are perspective views illustrating the insertion of a memory module into the conventional M.2 connector.
Figure 2A:
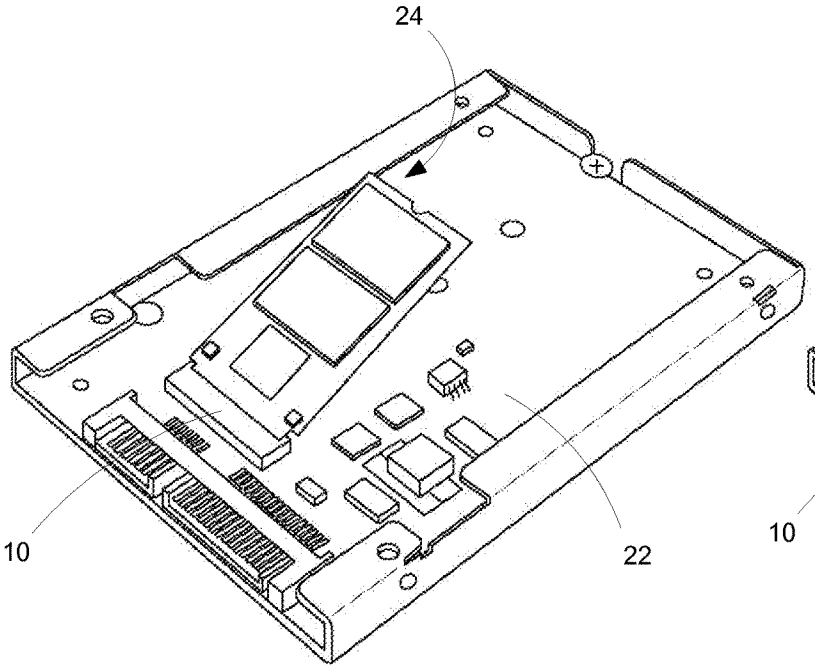
FIG. 2A (PRIOR ART)

As shown in FIGS. 2A and 2B, a conventional storage device, such as memory module 24, is initially inserted into the conventional connector 10 at an angle with respect to the printed circuit board (PCB) 22 and is subsequently rotated toward the PCB 22 such that it lies parallel with the PCB. The memory module 24 can be fastened in place with a suitable fastener 26. It can be appreciated from these figures that the memory module 24, when connected to a conventional M.2 connector 10, consumes a relatively large portion of the PCB's surface area.

Figure 3:
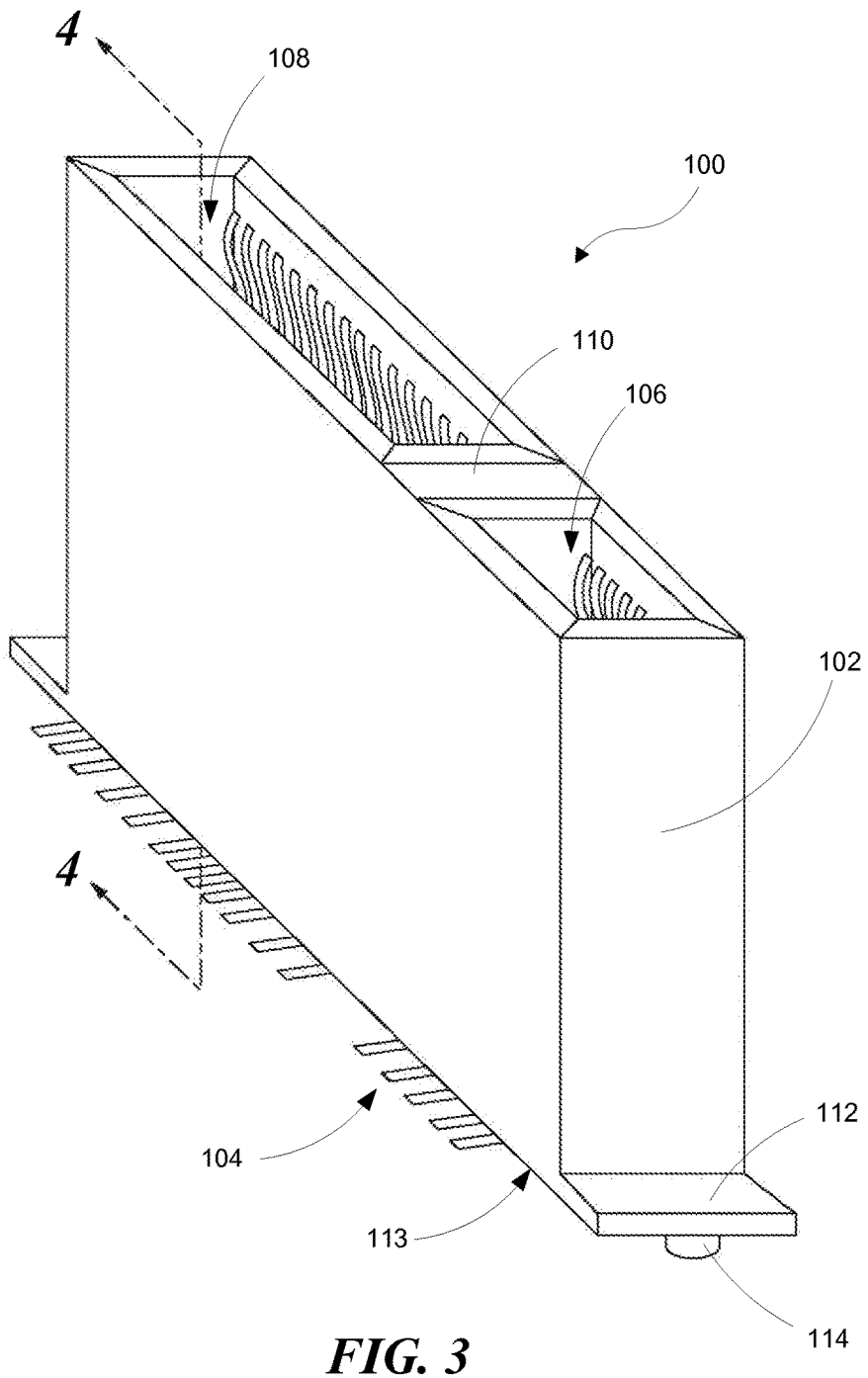
FIG. 3 is an isometric view of a connector according to a representative embodiment of the present technology.

FIG. 3 illustrates a connector 100 according to the disclosed technology. The connector 100 includes a connector body 102 having a mounting surface 113 and first and second receptacles 106 and 108, respectively. Unlike a conventional M.2 connector, the first and second receptacles 106 and 108 are oriented with their longitudinal axes substantially perpendicular to the mounting surface 113. Accordingly, the plane defined by the opening of each receptacle 106/108 is substantially parallel to the mounting surface 113. The plurality of terminals 104 extend through the mounting surface 113 and into the first and second receptacles 106 and 108, respectively. In some embodiments, the connector body 102 is a unitary body such as formed through injection molding. Terminals 104 are comprised of a suitable conductive material, such as copper alloy.

As noted, the connector 100 includes the mounting surface 113 that is perpendicular with respect to the receptacles 106 and 108; otherwise, connector 100 is M.2 compliant. For example, the terminal width $W_T$ and terminal pitch P are the same as for a conventional M.2 connector. Similarly, the receptacle opening width $W_R$ is the same as a conventional M.2 connector. Connector 100 also includes a partition 110 extending between the first and second receptacles 106 and 108. Thus, connector 100 can be keyed to match either an M or a B key according to M.2 standards. In some embodiments, connector body 102 includes mounting flanges 112 that forms a portion of the mounting surface 113 and that can include a protruding locating pin 114 configured to help position the connector 100 when mounting to a PCB.

Figure 4:
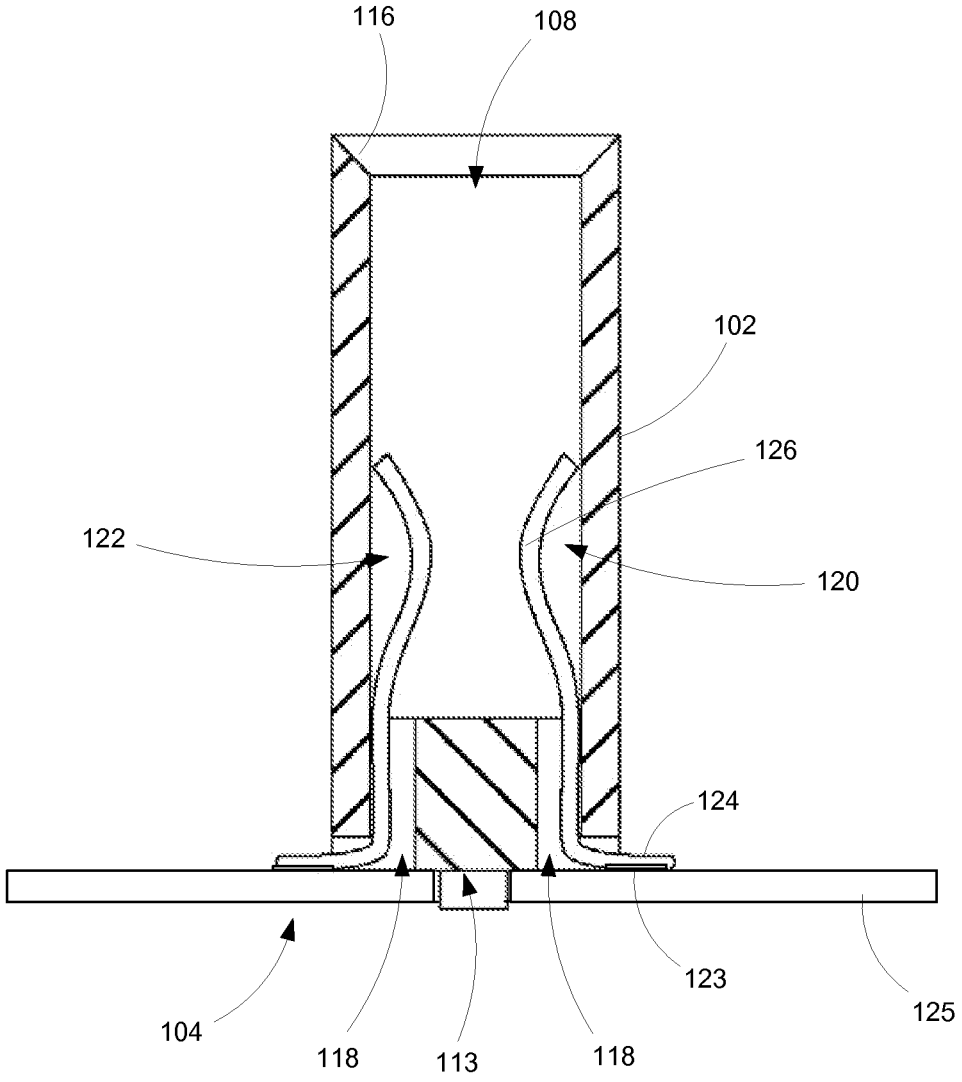
FIG. 4 is a cross-section of the connector of FIG. 3 taken about lines 4-4.

As shown in FIG. 4, the receptacles, such as receptacle 108, includes a chamfer 116 around the perimeter of the receptacle in order to facilitate insertion of a memory module. The plurality of terminals 104 includes a first set of terminals 120 positioned on one side of the connector body 102 and a second set of terminals 122 opposite from the first set of terminals, whereby the first and second sets of terminals can confront both sides of the memory module. Each terminal 104 extends through the mounting surface 113, through terminal apertures 118, and into the receptacle 108. Each terminal 104 includes a foot portion 124 that is solderable to a pad 123 on a PCB 125. Each terminal 104 also includes an arcuate contact portion 126 configured to releasably engage a corresponding pad of an M.2 memory module.

Figure 5:
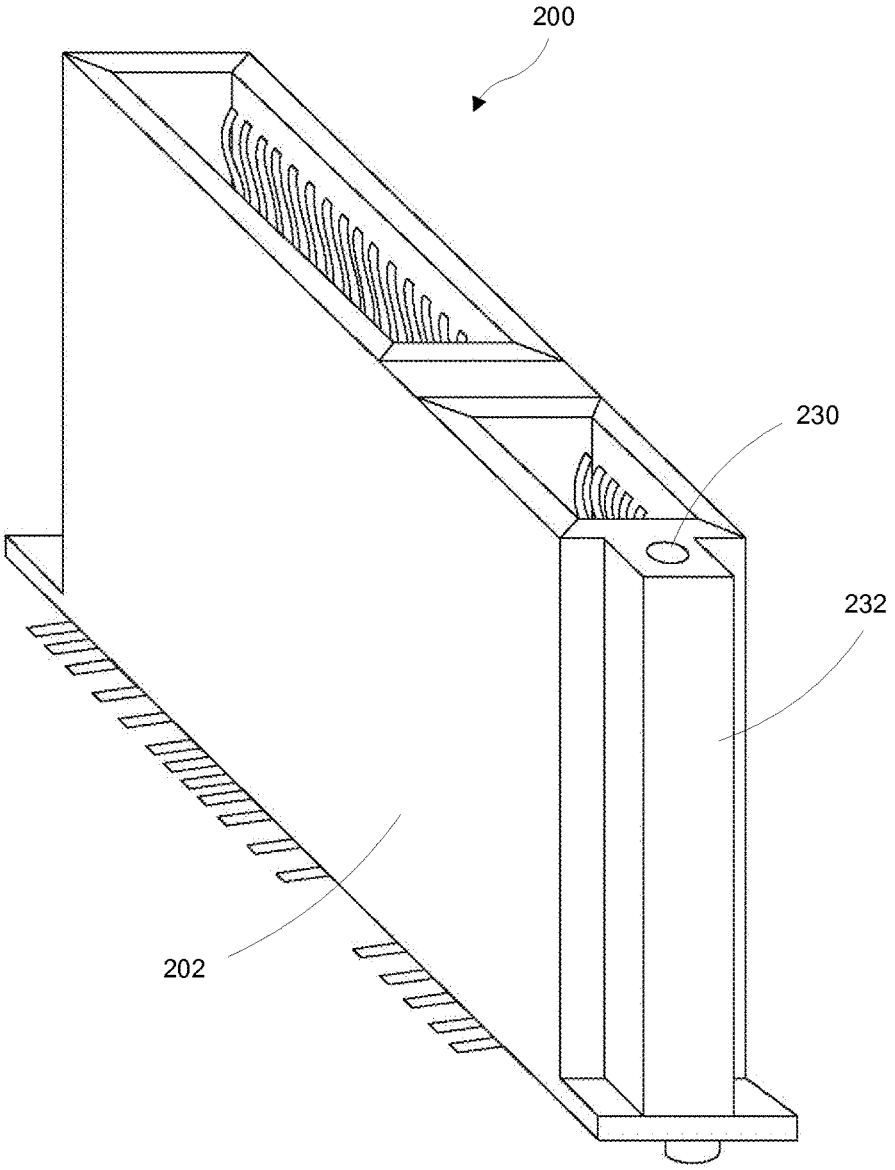
FIG. 5 is an isometric view of a connector according to another representative embodiment.

FIG. 5 illustrates a connector 200 according to another representative embodiment. Connector 200 is similar to the connector embodiment disclosed in FIGS. 3 and 4; however, it includes a visual indicator 230 positioned in an indicator boss 232 disposed on the connector body 202. In some embodiments, the visual indicator 230 can be a light emitting diode (LED) mounted in the boss 232 with suitable connections to be powered by a PCB. In other embodiments, the visual indicator 230 can comprise a light pipe, such as a fiber optic material, extending through the boss 232 to transfer light from a PCB-mounted LED.

Figure 6:
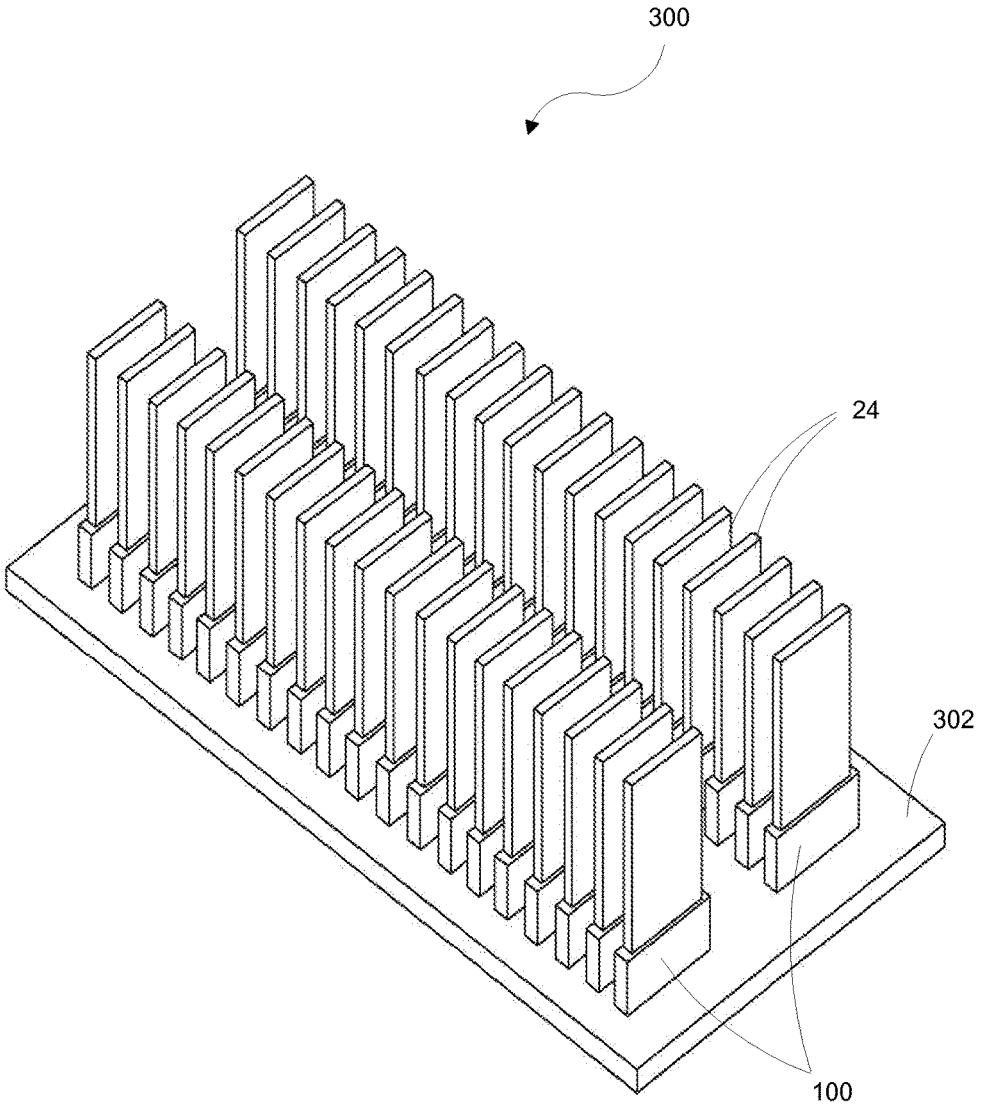
FIG. 6 is an isometric view of a memory unit according to a representative embodiment.

FIG. 6 illustrates a memory unit 300 according to a representative embodiment. Memory unit 300 includes a PCB 302 with a plurality of connectors 100 mounted on the PCB 302. A plurality of M.2 memory modules 24 are inserted into the connectors and are oriented perpendicular to the printed circuit board. Although the memory unit 300 is shown with connectors 100, in some embodiments, connectors 200 can be mounted to the PCB 302. As can be appreciated in FIG. 6, the perpendicularly oriented memory modules 24 consume less surface area of PCB 302 than if they were mounted to the printed circuit board 302 with a conventional M.2 connector such as that shown in FIGS. 1-2B. Accordingly, the disclosed connectors 100 and 200 allow many more memory modules 24 to be connected to a PCB. Although memory unit 300 is shown in a horizontal orientation, the memory unit 300 can also be positioned vertically. In other words, printed circuit board 302 can be positioned vertically rather than horizontally.

Remarks

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments. Accordingly, the embodiments are not limited except as by the appended claims.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

What is claimed is:

1. A connector for use with a printed circuit board (PCB) and a M.2 memory module, comprising:

a connector body having an indicator boss, a mounting surface configured to engage the PCB, and having first and second receptacles each with a longitudinal axis oriented substantially perpendicular to the mounting surface and configured to receive a portion of the M.2 memory module;

a visual indicator positioned in the indicator boss; and a plurality of terminals extending through the mounting surface and into the first and/or second receptacles, wherein the plurality of terminals are positioned to releasably engage the portion of the M.2 memory module.

2. The connector of claim 1, wherein the first and second receptacles each include a surrounding chamfer to facilitate insertion of the M.2 memory module.

3. The connector of claim 1, further comprising a pair of mounting flanges extending from the connector body.

4. The connector of claim 1, wherein the plurality of terminals includes a first set of terminals and a second set of terminals opposite from the first set of terminals, whereby the first set of terminals can releasably engage a first side of the M.2 memory module and the second set of terminals can releasably engage a second side of the M.2 memory module.

5. The connector of claim 1, wherein the plurality of terminals are spaced apart by a pitch of approximately 0.5 mm.

6. The connector of claim 1, wherein the plurality of terminals have a width ranging from approximately 0.12 mm to approximately 0.23 mm.

7. The connector of claim 1, wherein the first receptacle has a length corresponding to an M.2 B key.

8. The connector of claim 1, wherein the first receptacle has a length corresponding to 6 terminals.

9. The connector of claim 1, wherein the first receptacle has a length corresponding to an M.2 M key.

10. A connector for use with an M.2 memory module, comprising:

a connector body including a mounting surface and an indicator boss;

a visual indicator positioned in the indicator boss;

first and second receptacles formed in the connector body and oriented perpendicular to the mounting surface, wherein the first receptacle has a length corresponding to one of an M.2 M key and an M.2 B key; and a plurality of terminals extending through the mounting surface and into the first and second receptacles, wherein the plurality of terminals are spaced apart by a pitch of approximately 0.5 mm.

11. The connector of claim 10, further comprising a partition extending between the first and second receptacles.

12. The connector of claim 10, wherein the terminals each include a foot portion solderable to a printed circuit board and an arcuate contact portion configured to confront a corresponding pad on the M.2 memory module.

13. The connector of claim 10, wherein the visual indicator comprises a light pipe extending through the indicator boss.

14. The connector of claim 10, wherein the plurality of terminals have a width ranging from approximately 0.12 mm to approximately 0.23 mm.

15. A memory unit, comprising:

a printed circuit board;

a plurality of connectors mounted on the printed circuit board, each of the plurality of connectors including:

a connector body including a mounting surface and an indicator boss;

a visual indicator positioned in the indicator boss;

first and second receptacles formed in the connector body and oriented perpendicular to the mounting surface; and a plurality of terminals extending through the mounting surface and into the first and second receptacles; and a plurality of M.2 memory modules inserted into the connectors and oriented perpendicular to the printed circuit board.

16. The memory unit of claim 15, wherein each visual indicator comprises a light pipe extending through the indicator boss and wherein the printed circuit board includes a light corresponding to each connector and positioned to transmit light through the light pipe.

17. The memory unit of claim 15, wherein each first receptacle has a length corresponding to one of an M.2 M key and an M.2 B key.

18. The memory unit of claim 15, wherein the plurality of terminals are spaced apart by a pitch of approximately 0.5 mm.

19. The memory unit of claim 15, wherein the plurality of terminals have a width ranging from approximately 0.12 mm to approximately 0.23 mm.

* * * * *